US009751343B2

(12) United States Patent
Sakaguchi

(10) Patent No.: US 9,751,343 B2
(45) Date of Patent: Sep. 5, 2017

(54) RECORDING APPARATUS

(71) Applicant: BROTHER KOGYO KABUSHIKI KAISHA, Nagoya-shi, Aichi-ken (JP)

(72) Inventor: Shintaro Sakaguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/269,095

(22) Filed: Sep. 19, 2016

(65) Prior Publication Data

US 2017/0087893 A1 Mar. 30, 2017

(30) Foreign Application Priority Data

Sep. 29, 2015 (JP) ..... 2015-190854

(51) Int. Cl.
*B41J 13/00* (2006.01)
*B41J 11/00* (2006.01)

(52) U.S. Cl.
CPC ..... *B41J 13/0009* (2013.01); *B41J 11/002* (2013.01); *B41J 13/0036* (2013.01); *B41J 13/0045* (2013.01); *B41J 13/0054* (2013.01)

(58) Field of Classification Search
CPC .. B41J 13/0054; B41J 11/002; B41J 13/0036; B41J 13/0045
See application file for complete search history.

(56) References Cited

U.S. PATENT DOCUMENTS

2005/0073535 A1* 4/2005 Seki ..... B41J 13/0045 347/5
2008/0204497 A1* 8/2008 Furuhata ..... B41J 3/60 347/16
2009/0102908 A1* 4/2009 Imoto ..... B41J 3/44 347/104
2014/0092162 A1 4/2014 Nishihara

FOREIGN PATENT DOCUMENTS

JP H11-286100 A 10/1999
JP 2008/183719 A 8/2008
JP 2014/080011 A 5/2014

* cited by examiner

*Primary Examiner* — Julian Huffman
(74) *Attorney, Agent, or Firm* — Scully, Scott, Murphy & Presser, PC

(57) ABSTRACT

There is provided a recording apparatus including a liquid jetting unit, a container unit and a receiving unit for a recording medium, a conveyance unit, and a controller. The controller carries out: determining whether or not it is necessary to stop and dry the recording medium in a conveyance path, determining whether or not a first length of the recording medium along the conveyance direction is equal to or larger than a predetermined value, when it is necessary to dry the recording medium, and controlling the conveyance unit to convey the recording medium to a switchback path by reversing the conveyance direction and stop the recording medium in a state of being at least partially within the switchback path, and then to cause the receiving unit to receive the recording medium, when it is determined that the first length is equal to or larger than the predetermined value.

11 Claims, 8 Drawing Sheets

VERTICAL DIRECTION (D2) MAIN SCANNING DIRECTION

SECONDARY SCANNING DIRECTION

VERTICAL DIRECTION

MAIN SCANNING DIRECTION

SECONDARY SCANNING DIRECTION

RECORDING APPARATUS

CROSS REFERENCE TO RELATED APPLICATION

The present application claims priority from Japanese Patent Application No. 2015-190854 filed on Sep. 29, 2015, the disclosure of which is incorporated herein by reference in its entirety.

FIELD OF THE INVENTION

The present invention relates to recording apparatuses carrying out a recording operation by jetting a liquid onto a recording medium.

DESCRIPTION OF THE RELATED ART

Conventionally, such an operation is known that in order to prevent ink (liquid) from adhering to a discharge portion (receiving unit) or recording paper (recording media) placed in the discharge portion, the recording paper with the ink jetted thereon is discharged to the discharge portion with its ink jetted surface facing (the bottom of) the discharge portion, after being caused to stand by (to stop) and dry on the inner side of guides (in a downstream path) provided on the downstream side from a recording head and on the upstream side from the discharge portion.

With the technique mentioned above, such a problem may arise that when the recording medium is long along a conveyance direction, then during the recording medium being stopped in the downstream path, an anterior end portion of the recording medium (an end portion of the recording medium in the direction from upstream toward downstream of the downstream path) is maintained in a state of contact with the receiving unit or the recording media received by the receiving unit such that the liquid adhering to the anterior end portion of the recording medium may transfer to the receiving unit or the recording media received by the receiving unit.

It is an object of the present teaching to provide a recording apparatus capable of preventing such a problem from happening that during a recording medium being stopped and dried, any liquid adhering to the recording medium may transfer to the receiving unit or the recording media received by the receiving unit, even when the recording medium is long along the conveyance direction in the case of needing to stop and dry the liquid jetted recording medium in the conveyance path.

SUMMARY

According to an aspect of the present teaching, there is provided a recording apparatus configured to jet liquid onto a recording medium comprising:

a liquid jetting unit including a plurality of nozzles to jet the liquid;

a container unit configured to contain the recording medium to be fed to the liquid jetting unit;

a receiving unit configured to receive the recording medium on which the liquid has been jetted by the liquid jetting unit;

a conveyance unit configured to convey the recording medium from the container unit to the receiving unit via a facing position facing the plurality of nozzles; and a controller configured to control the conveyance unit and the liquid jetting unit, wherein inside the recording apparatus, a conveyance path is defined to extend from the container unit to the receiving unit via the facing position facing the plurality of nozzles;

wherein the conveyance unit is configured to convey the recording medium along the conveyance path which includes an upstream path from the container unit to the facing position, a downstream path from the facing position to the receiving unit, and a switchback path diverging from the downstream path and returning to the upstream path or the downstream path; and wherein the controller is configured to carry out:

determining whether or not it is necessary to stop and dry the liquid jetted recording medium in the conveyance path, under a condition that recording is carried out on the recording medium, determining whether or not a first length of the recording medium along a conveyance direction for the conveyance unit to convey the recording medium is equal to or larger than a predetermined value, under a condition that it is determined that it is necessary to dry the recording medium, and controlling the conveyance unit to convey the recording medium, which is conveyed from the upstream path to the downstream path and finished with the recording carried out at the facing position, to the switchback path by reversing the conveyance direction and stop the recording medium in a state of being at least partially within the switchback path, and then to cause the receiving unit to receive the recording medium with its liquid jetted surface facing the receiving unit, under a condition that it is determined that the first length is equal to or larger than the predetermined value.

According to the present teaching, when it is necessary to stop and dry the liquid jetted recording medium in the conveyance path, then such a process (second determination process) is carried out as to determine whether or not the first length of the recording medium is equal to or larger than the predetermined value. When it is determined in the second determination process that the first length of the recording medium is equal to or larger than the predetermined value, then the recording medium is stopped in the state of being at least partially within the switchback path. By virtue of this, it is possible to prevent the problem that during the recording medium being stopped and dried, any liquid adhering to the recording medium may transfer to the receiving unit or the recording media received by the receiving unit, even when the recording medium is long along the conveyance direction in the case of needing to stop and dry the liquid jetted recording medium in the conveyance path.

DESCRIPTION OF THE EMBODIMENTS

Figure 1:
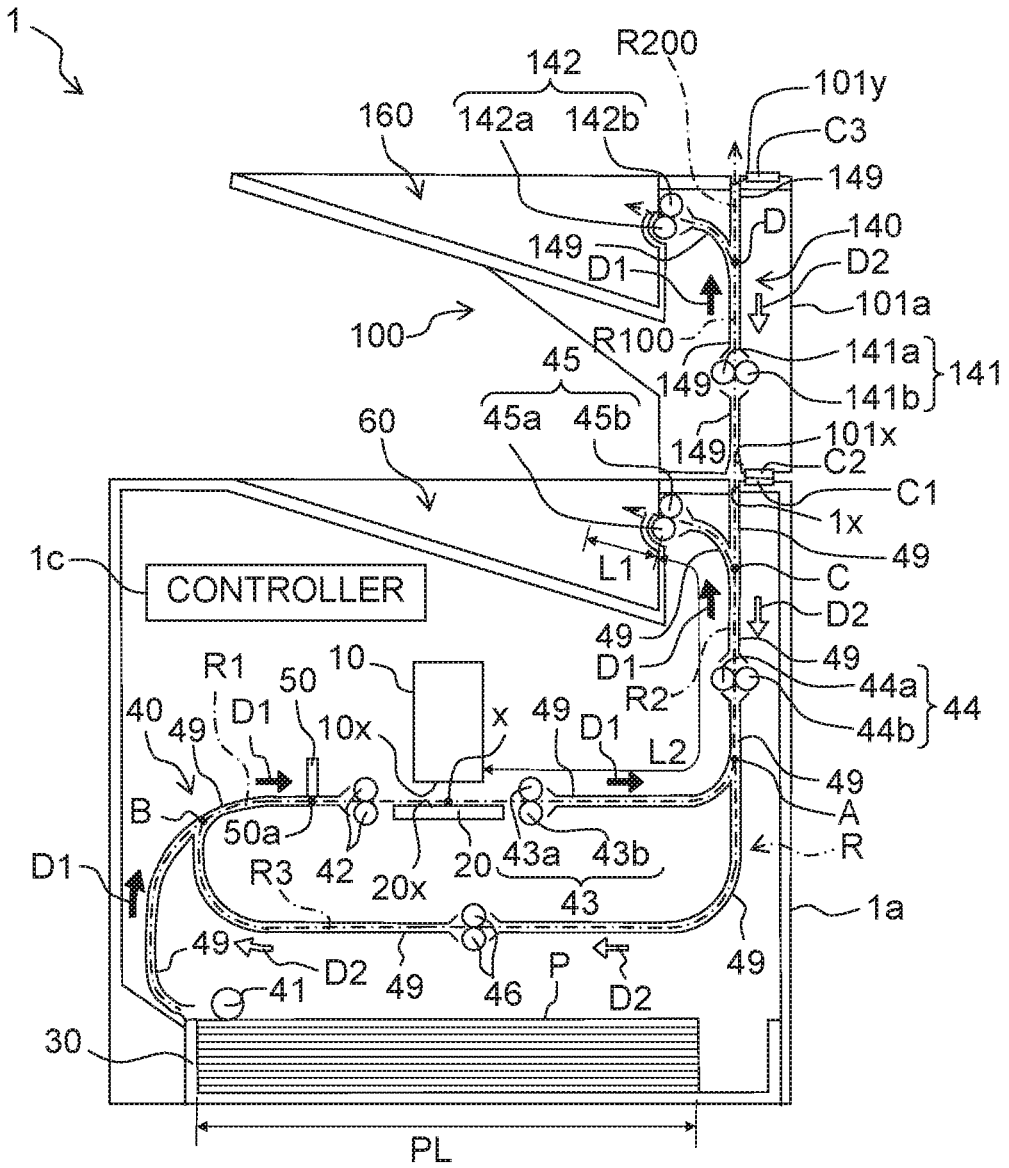
FIG. 1 is a schematic lateral view of the inside of an ink jet printer according to an embodiment of the present teaching.

As depicted in FIG. 1, an ink jet printer 1 (to be referred to simply as "printer", hereinbelow) according to one embodiment of the present teaching has a case 1*a*. The case 1*a* contains, in its inner space, an ink jet head 10 (to be referred to simply as "head", hereinbelow), a platen 20, a paper feed tray 30, a conveyance unit 40, a paper sensor 50, and a controller 1*c*. A receiving unit 60 is provided in an upper part over a top board of the case 1*a*.

Figure 2:
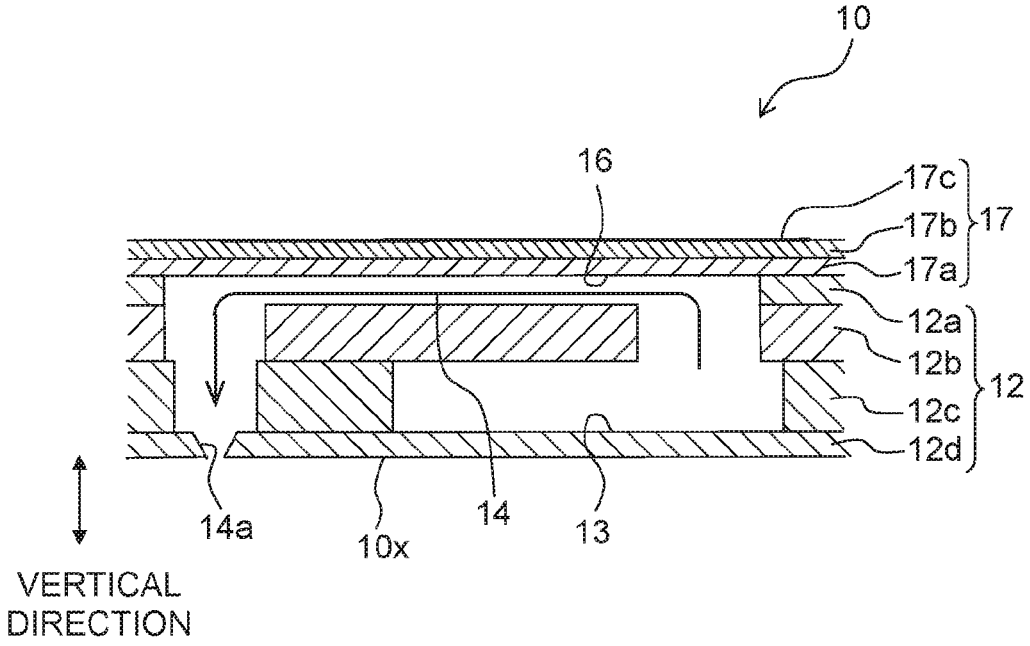
FIG. 2 is a partial cross-sectional view of an ink jet head included in the ink jet printer of FIG. 1.

The head 10 corresponds to the "liquid jetting unit" of the present teaching. The head 10 of this embodiment is a line head elongated in a main scanning direction and, as depicted in FIG. 2, includes a channel unit 12 and an actuator unit 17.

The channel unit 12 is a layered body formed by layering plates 12*a* to 12*d*. A channel is formed inside the channel unit 12. The lower surface of the channel unit 12 serves as a jet surface 10*x* with a plurality of jet openings 14*a* formed to open thereon. The channel formed inside the channel unit 12 includes one manifold channel 13 and a plurality of individual channels 14. The individual channels 14 are each provided for one of the jet openings 14*a*, and extend from an exit of the manifold channel 13 to the jet openings 14*a* via pressure chambers 16. The manifold channel 13 is in communication with a tank (not depicted) retaining an ink. The ink supplied from the tank to the manifold channel 13 passes through the individual channels 14 to be jetted from the jet openings 14*a*.

The actuator unit 17 is another layered body formed by layering a vibration plate 17*a*, a piezoelectric layer 17*b*, and a plurality of individual electrodes 17*c*. The vibration plate 17*a* is fixed on the upper surface of the channel unit 12 to seal up the plurality of pressure chambers 16. The piezoelectric layer 17*b* is fixed on the upper surface of the vibration plate 17*a* to face the plurality of pressure chambers 16. The plurality of individual electrodes 17*c* are fixed on the upper surface of the piezoelectric layer 17*b* to respectively face the plurality of pressure chambers 16. Such a part of the actuator unit 17 as interposed between each of the individual electrodes 17*c* and the corresponding one of the pressure chambers 16 functions as an individual actuator of unimorph type for each of the pressure chambers 16, and is capable of independent deformation in response to the application of a voltage to the individual electrodes 17*c*. With the actuator deformed to project toward the corresponding pressure chamber 16, the volume of that pressure chamber 16 decreases such that a pressure is applied to the ink inside that pressure chamber 16 and thus the ink is jetted from the corresponding jet opening 14*a*.

The platen 20 is formed of a flat plate, and arranged in a position facing the jet surface 10*x*. A predetermined interspace appropriate for recording is formed between the jet surface 10*x* and a surface 20*x* of the platen 20.

The paper feed tray 30 corresponds to the "container unit" of the present teaching, serving to contain recording paper or simply paper P to be fed to the head 10. The paper P corresponds to the "recording medium" of the present teaching. The paper feed tray 30 is capable of containing a plurality of sheets of the paper P as well as capable of containing the paper P in multi-type sizes, and is attachable to and removable from the case 1*a*.

The conveyance unit 40 is configured to convey the paper P along a conveyance path R from the paper feed tray 30 up to the receiving unit 60 via a facing position X facing the jet surface 10*x*. The conveyance path R includes an upstream path R1 from the paper feed tray 30 to the facing position X, a downstream path R2 from the facing position X to the receiving unit 60, and a switchback path R3 which diverges from the downstream path R2 and returns to the upstream path R1.

The switchback path R3 diverges from the downstream path R2 at a divergence position A prescribed in the downstream path R2, and merges into the upstream path R1 at a mergence position B prescribed in the upstream path R1. The switchback path R3 passes below the head 10 and platen 20, with the divergence position A as one end and with the mergence position B as the other end. At the divergence position A, a switch mechanism (not depicted) is arranged for switching the transportation of the paper P to either the path R2 or the path R3. At the mergence position B, another switch mechanism (not depicted) is arranged for switching the transportation of the paper P to either the path R1 or the path R3. Both of the switch mechanisms are controlled by the controller 1*c* to convey the paper P along the determined path.

The conveyance unit 40 includes a paper feed roller 41, roller pairs 42 to 46, and a plurality of guides 49.

Figure 3:
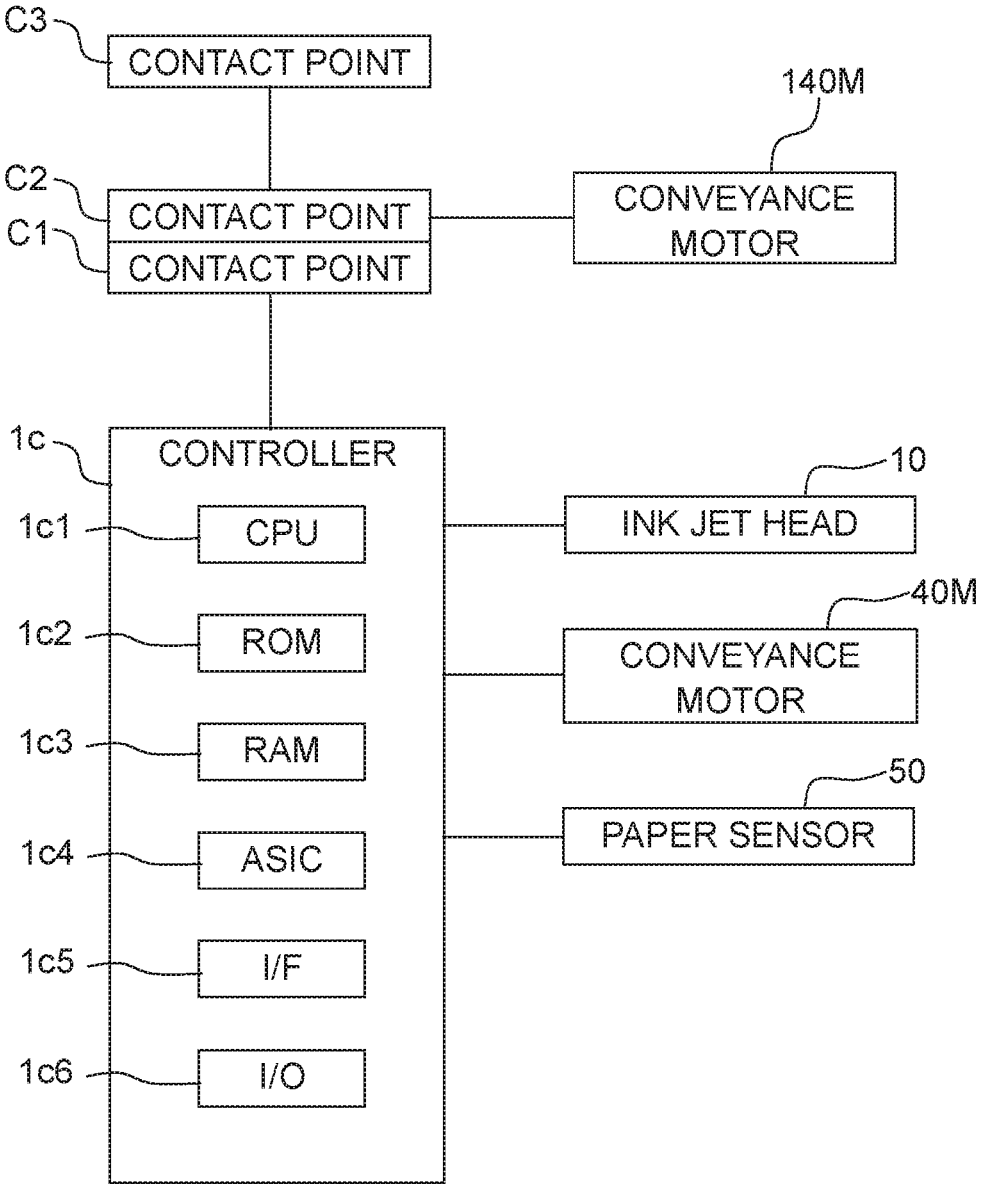
FIG. 3 is a block diagram showing an electrical configuration of the ink jet printer of FIG. 1.

The paper feed roller 41 is arranged in a position to contact with the uppermost sheet of the paper P in the paper feed tray 30. The paper feed roller 41 is caused to rotate by a conveyance motor 40M (see FIG. 3) being driven under the control of the controller 1*c*, to send out the uppermost sheet of the paper P in the paper feed tray 30.

The roller pairs 42 to 46 are arranged at predetermined intervals along the conveyance path R. Each of the roller pairs 42 to 46 is configured to include two rollers in contact with each other, to nip the paper P with those two rollers while conveying the same. One of the two rollers constituting each pair of the rollers 42 to 46 is a driving roller which is caused to rotate by the conveyance motor 40M (see FIG. 3) being driven under the control of the controller 1*c*. The other of the two rollers constituting each pair of the rollers 42 to 46 is a driven roller which rotates along with the rotation of the driving roller, in the reverse direction from the driving roller while in contact with the driving roller. The rotating roller pairs 42 to 46 convey, along the conveyance path R, the paper P sent out from the paper feed tray 30 by the paper feed roller 41.

The roller pairs 42, 43 and 46 are rotatable only in a forward direction (which is the direction D1 indicated with the black arrows in FIG. 1 for the roller pairs 42 and 43 to convey the paper P, but the direction D2 indicated with the outline arrows in FIG. 1 for the roller pair 46 to convey the paper P). The roller pairs 44 and 45 are rotatable in the forward and backward directions (the direction D1 of conveying the paper P and the direction D2 of conveying the paper P).

With respect to each pair of the rollers 43 to 45 arranged in the downstream path R2, one of rollers 43*a* to 45*a* (rollers in contact with the surface of the paper P on which the ink is jetted at the facing position X in the latest recording) is a spur roller having a plurality of projections on its outer circumference, while the other of rollers 43*b* to 45*b* is a rubber roller.

The roller pair 45 corresponds to the "support member" of the present teaching, serving to support the paper P at the most downstream point in the downstream path R2.

The roller pair 46 corresponds to the "conveyance member" of the present teaching, serving to contact with the paper P in the switchback path R3 to convey the paper P.

Each of the guides 49 includes a pair of plates arranged to face each other across an interspace, so as to form a space through which the paper P is conveyed along the conveyance path R.

The paper sensor 50 outputs, to the controller 1*c*, an ON signal when the paper P is present at a detection position 50*a* prescribed in the upstream path R1 or an OFF signal when the paper P is absent at the detection position 50*a*.

The receiving unit 60 is constructed from the top board of the case 1*a* in this embodiment, to receive the paper P conveyed thereto through the conveyance path R.

The controller 1*c* includes a CPU 1*c*1 (Central Processing Unit) which is a computation processing device, a ROM 1*c*2 (Read Only Memory), a RAM 1*c*3 (Random Access Memory), an ASIC 1*c*4 (Application Specific Integrated Circuit), an I/F 1*c*5 (Interface), and an I/O 1*c*6 (Input/Output Port). The ROM 1*c*2 stores fixed data such as programs and the like for the CPU 1*c*1 to execute. The RAM 1*c*3 temporarily stores data (image data and the like) needed for the CPU 1*c*1 to execute the programs. The ASIC 1*c*4 carries out processes of rewriting and sorting the image data, etc. (for example, signal processing and image processing). The I/F 1*c*5 carries out data transmissions with an external device (for example, a PC connected to the printer 1). The I/O 1*c*6 carries out signal transmissions with various sensors including the paper sensor 50.

The printer 1 is provided with an attachable/removable expanded unit 100. The expanded unit 100 has a case 101*a*. The case 101*a* contains an expanded conveyance unit 140 in its inner space. An expanded receiving unit 160 is provided in an upper portion over the top board of the case 101*a*.

The case 101*a* is arranged above the case 1*a* in such a manner that an opening 1*x* formed in the upper side of the case 1*a* may face an opening 101*x* formed in the lower side of the case 101*a*, and a contact point C1 provided on the upper side of the case 1*a* may contact with a contact point C2 provided on the lower side of the case 101*a*. The contact point C1 is electrically connected with the controller 1*c* (see FIG. 3). When the expanded unit 100 is installed on the printer 1 (that is, the case 101*a* is disposed on the case 1*a* from above), then the contact points C1 and C2 are in contact with each other and thus connected electrically such that via the contact points C1 and C2, signal transmissions are enabled between the controller 1*c* and each element of the expanded unit 100.

The expanded conveyance unit 140 is configured to convey the paper P along an expanded conveyance path R100 which diverges from the downstream path R2 to extend toward the expanded receiving unit 160. The expanded conveyance path R100 is longer than such a downstream portion (downstream according to the direction D1) of the downstream path R2 as from a divergence position C from the expanded conveyance path R100. The divergence position C is located on the upstream side from the roller pair 45 according to the direction D1 but on the downstream side from the divergence position A and the roller pair 44 according to the direction D1. At the divergence position C, a switch mechanism (not depicted) is arranged for switching the transportation of the paper P to either the path R2 or the path R100. The switch mechanism is controlled by the controller 1*c* to convey the paper P along the determined path.

The expanded conveyance unit 140 includes roller pairs 141 and 142, and a plurality of guides 149.

The roller pairs 141 and 142 are arranged at a predetermined interval along the expanded conveyance path R100. Each of the roller pairs 141 and 142 is configured to include two rollers in contact with each other, so as to nip the paper P with those two rollers while conveying the paper P. One of the two rollers constituting each of the roller pairs 141 and 142 is a driving roller which is caused to rotate by a conveyance motor 140M (see FIG. 3) being driven under the control of the controller 1*c*. The other of the two rollers constituting each of the roller pairs 141 and 142 is a driven roller which rotates along with the rotation of the driving roller, in the reverse direction from the driving roller while in contact with the driving roller. The rotating roller pairs 141 and 142 convey, along the expanded conveyance path R100, the paper P supplied to the expanded unit 100 via the opening 1*x* and the opening 101*x*.

The roller pairs 141 and 142 are rotatable in the forward and backward directions (the direction of conveying the paper P in the direction D1 and the direction of conveying the paper P in the direction D2). Further, with respect to each of the roller pairs 141 and 142, one of rollers 141*a* and 142*a* (rollers in contact with the surface of the paper P on which the ink is jetted at the facing position X in the latest recording) is a spur roller having a plurality of projections on its outer circumference, while the other of rollers 141*b* to 142*b* is a rubber roller.

Each of the guides 149 includes a pair of plates arranged to face each other across an interspace, so as to form a space through which the paper P is conveyed along the expanded conveyance path R100.

The expanded receiving unit 160 serves to receive the paper P conveyed thereto through the expanded conveyance path R100.

The upper side of the case 101*a* is provided with an opening 101*y* and a contact point C3 such that it is possible to install another expanded unit on the upper side of the expanded unit 100. An expanded conveyance path R200 of the other expanded unit diverges from a divergence position D prescribed in the expanded conveyance path R100 of the expanded unit 100 to extend toward an extended receiving unit of the other extended unit. At the divergence position D, a switch mechanism (not depicted) is arranged for switching the transportation of the paper P to either the path R100 or the path R200. The switch mechanism is controlled by the controller 1*c* to convey the paper P along the determined path.

Next, referring to FIGS. 4A to 7, an explanation will be made on contents of the control carried out by the controller 1*c* (or by the CPU 1*c*1 in detail).

Further, the following explanation is related to a control of conveying the paper P, whereas explanations will be omitted for the control of driving the head 10. Further, although the switch mechanisms (not depicted) arranged at the divergence position A, the mergence position B and the divergence position C (and also the divergence position D when the expanded unit 100 is installed on the printer 1) are controlled in accordance with conveying the paper P, explanation will be omitted for the control of the switch mechanisms.

Figure 4A:
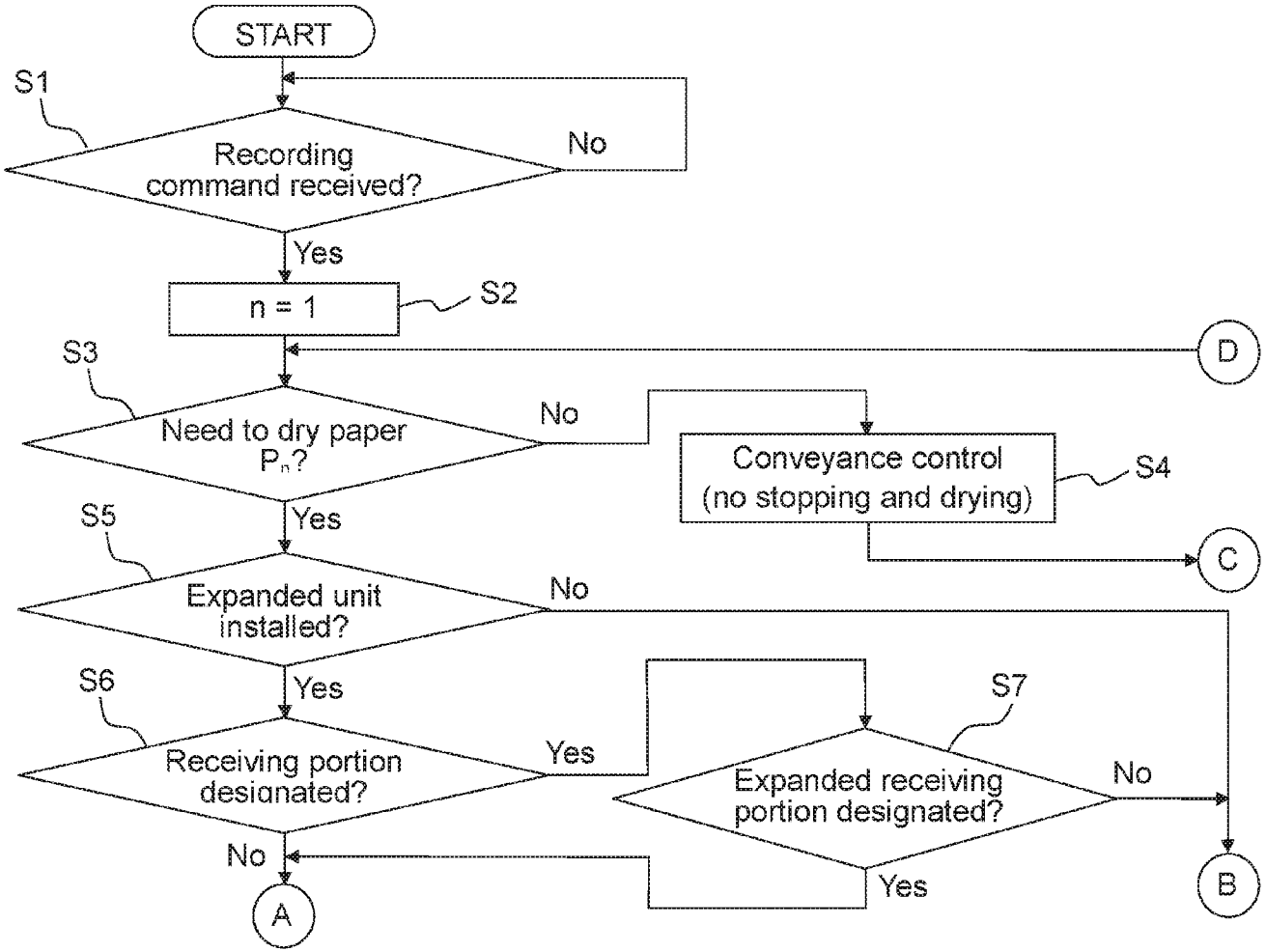
FIGS. 4A and 4B are flow diagram showing contents of a control carried out by a controller of the ink jet printer of FIG. 1.
Figure 4B:
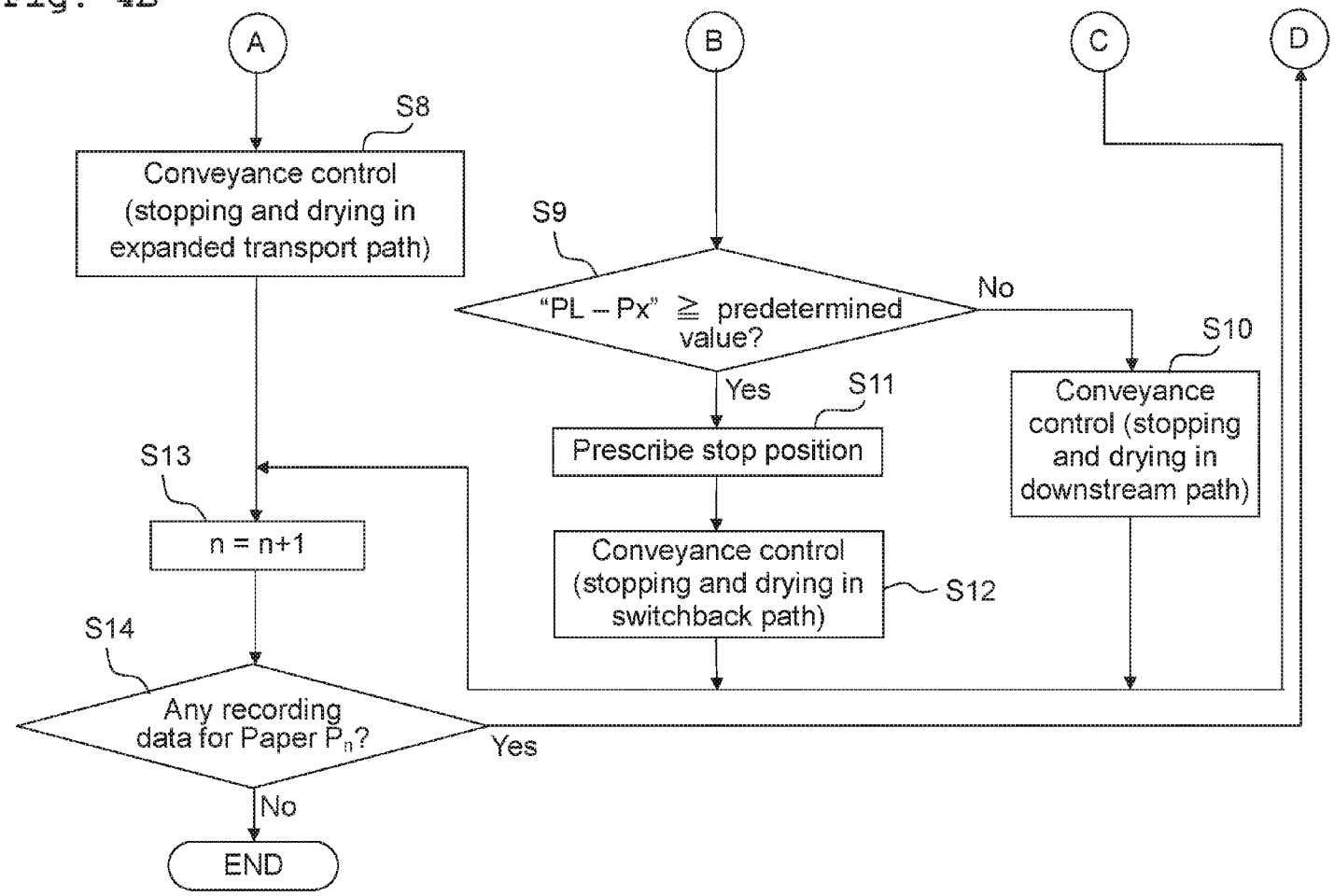

As depicted in FIG. 4A, the CPU 1*c*1 first determines whether or not a recording command (the command instructing the recording to be carried out on the nth sheet of the paper P, where n is a natural number) is received from the external device (S1). When it is determined that the recording command is not received (S1: No), then the CPU 1c1 repeats the process of step S1. Further, in the following explanation, step S1 may also be referred to simply as S1.

When it is determined that the recording command is received (S1: Yes), then the CPU 1c1 sets "n=1" (S2). After S2, the CPU 1c1 determines whether or not it is necessary to stop and dry, either in the conveyance path R or in the expanded conveyance path R100, the nth sheet of the paper $P_n$ on which the recording should be carried out based on that recording command, after being recorded thereon (that is, after the ink is jetted thereon at the facing position X) but before being received by the receiving unit 60 or the expanded receiving unit 160 (S3). The determination of step S3 is carried out on the basis of, for example, the amount of the ink jetted on the paper $P_n$, the type of the paper $P_n$, and the like.

When it is determined that it is not necessary to dry the paper $P_n$ (S3: No), then the CPU 1c1 carries out "Conveyance control (no stopping and drying)" (S4). In S4, the CPU 1c1 controls the conveyance unit 40 (and also the expanded conveyance unit 140 when the expanded unit 100 is installed on the printer 1) such that the paper $P_n$ may not be stopped in the conveyance path R or the expanded conveyance path R100 for being dried in between the paper feed tray 30 and the receiving unit 60 or the expanded receiving unit 160.

In step S4, in the case of a single side recording, the paper $P_n$ is conveyed from the paper feed tray 30 along the direction D1, passes through the upstream path R1, arrives at the facing position X and, after the recording is carried out on the first surface at the facing position X, passes through the downstream path R2 to be received by the receiving unit 60. Further, when the expanded unit 100 is installed on the printer 1 and the expanded receiving unit 160 is designated to receive the paper $P_n$, then the paper $P_n$ passes through the expanded conveyance path R100 to be received by the expanded receiving unit 160 after the recording is carried out on the first surface at the facing position X. Further, the single side recording refers to a recording on the paper P, wherein each sheet of the paper P has two surfaces: a first surface and a second surface on the other side of the first surface, and the recording is on the first surface. Further, a both side recording refers to a recording on the paper P, wherein each sheet of the paper P has two surfaces: a first surface and a second surface on the other side of the first surface, and the recording is on both of the two surfaces.

In step S4, in the case of the both side recording, the paper $P_n$ is conveyed from the paper feed tray 30 along the direction D1, passes through the upstream path R1, arrives at the facing position X. After the recording is carried out on the first surface at the facing position X, the paper $P_n$ is conveyed into the downstream path R2 and stopped for a time in a state of being nipped by the roller pairs 44 and 45. Then, the paper $P_n$ is caused to reverse its conveyance direction by the backward rotations of the roller pairs 44 and 45, and is conveyed along the direction D2 from the downstream path R2 to the switchback path R3. Here, the direction refers to a direction for the conveyance unit 40 to convey the paper P. Thereafter, the paper $P_n$ is not caused to reverse its conveyance direction but to pass through the mergence position B from the switchback path R3 along the direction D2 and return to the upstream path R1. Then, the paper $P_n$ is conveyed again in the direction D1 and, after the recording is carried out on the second surface at the facing position X, passes through the downstream path R2 to be received by the receiving unit 60. Further, when the expanded unit 100 is installed on the printer 1 and the expanded receiving unit 160 is designated to receive the paper $P_n$, then the paper $P_n$ passes through the expanded conveyance path R100 to be received by the expanded receiving unit 160 after the recording is carried out on the second surface at the facing position X.

When it is determined that it is necessary to dry the paper $P_n$ (S3: Yes), then based on whether or not the contact points C1 and C2 are connected electrically, the CPU 1c1 determines whether or not the expanded unit 100 is installed on the printer 1 (S5). When it is determined that the expanded unit 100 is installed on the printer 1 (S5: Yes), then the CPU 1c1 refers to the data designated by a user and included in the recording command to determine whether or not a receiving unit is designated. That is, whether the receiving unit 60 or the expanded receiving unit 160 is designated to receive the paper $P_n$ (S6). When it is determined that the receiving unit is designated (S6: Yes), then the CPU 1c1 determines whether or not the expanded receiving unit 160 is designate as the receiving unit (S7).

Figure 5:
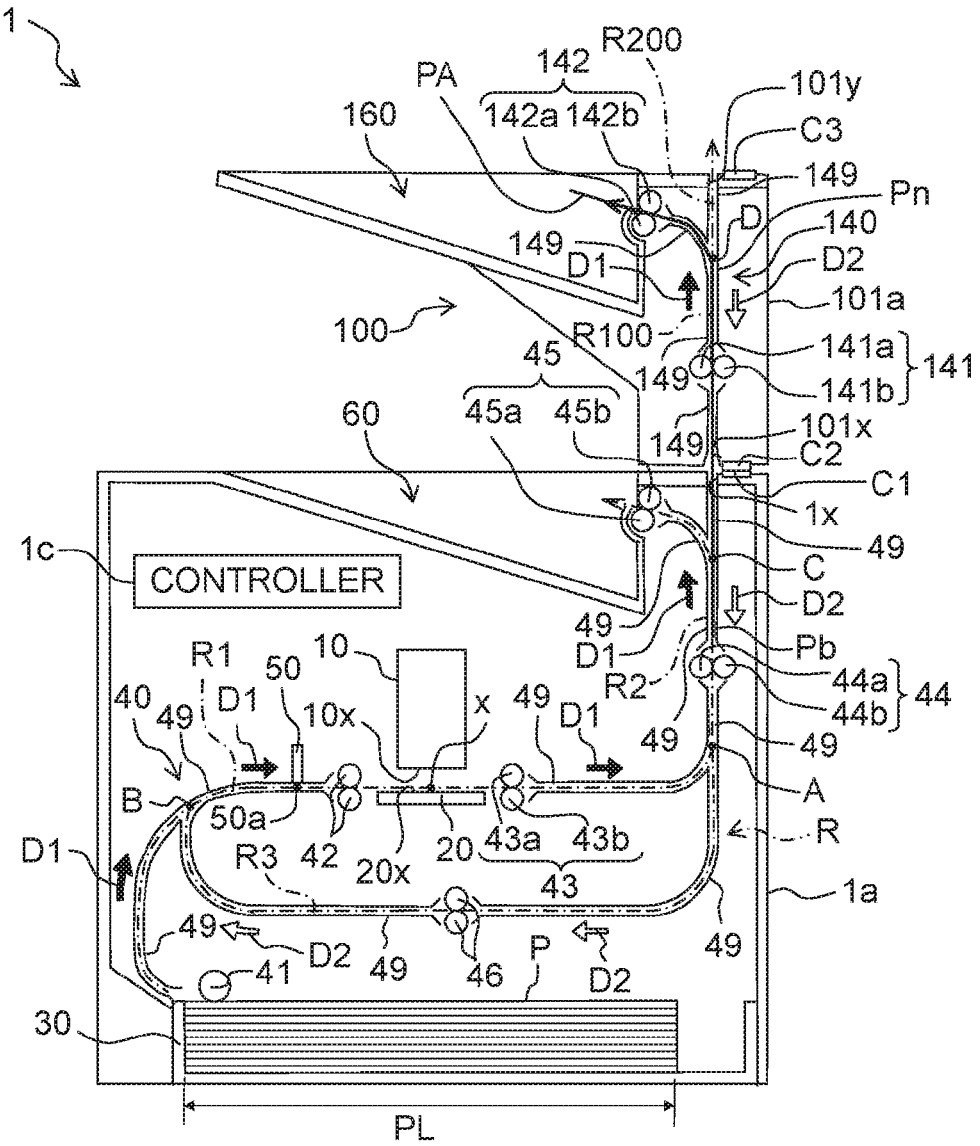
FIG. 5 is a schematic lateral view showing a state of recording paper stopping in an expanded conveyance path, in a step S8 "Conveyance control (stopping and drying in the expanded conveyance path)" of FIG. 4B.
Figure 6:
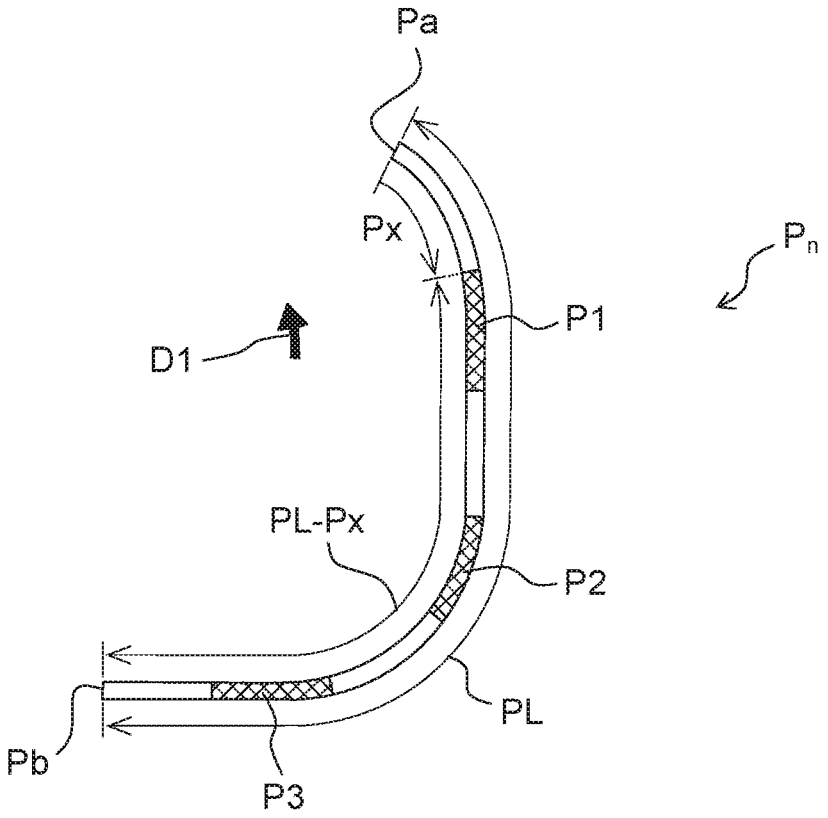
FIG. 6 is a schematic lateral view showing areas where a predetermined amount or more of ink is jetted on the recording paper.

When it is determined that no receiving unit is designated (S6: No) or when the expanded receiving unit 160 is designate as the receiving unit (S7: Yes), then the CPU 1c1 carries out "Conveyance control (stopping and drying in the expanded conveyance path)" (S8). In S8, the CPU 1c1 controls the conveyance unit 40 and the expanded conveyance unit 140 to stop the paper $P_n$, which passes through the same path as in S4 and on which the recording is carried out either on the first surface in the case of the single side recording or on both surfaces in the case of the both side recording, in a state of being at least partially within the expanded conveyance path R100, as depicted in FIG. 5, before being conveyed through the expanded conveyance path R100 to be received by the expanded receiving unit 160. Then, the CPU 1c1 controls the expanded conveyance unit 140 to convey the paper $P_n$ in the direction D1 after the paper $P_n$ is dried, and causes the expanded receiving unit 160 to receive the paper $P_n$ with its ink jetted surface facing (the board side of) the expanded receiving unit 160.

When it is determined that the expanded unit 100 is not installed on the printer 1 (S5: No) or when it is determined that the expanded receiving unit 160 is not designated as the receiving unit (that is, the receiving unit 60 is designated as the receiving unit) (S7: No), then the CPU 1c1 determines whether or not "PL−Px" is equal to or larger than a predetermined value (S9). Further, PL refers to the length of the paper $P_n$ along the conveyance direction, that is, the entire length of the paper $P_n$. Further, Px refers to the length along the conveyance direction from the end Pa (to be referred to below as "anterior end Pa") of the $P_n$ according to the direction D1, to such an area (the area P1 in FIG. 6) of the paper $P_n$ as closest to the anterior end Pa in the conveyance direction among the areas P1 to P3 where a predetermined amount or more of the ink is jetted. Here, the Direction D1 refers to the direction from upstream toward downstream of the downstream path R2. In this embodiment, PL is sought from the signal from the paper sensor 50 and the number of rotations of the conveyance motor 40M. To replace or add to that, PL may be sought from a paper length sensor provided in the paper feed tray 30, some data included in the recording command to indicate the paper size, and the like. The areas P1 to P3 may be sought from the image data included in the recording command. The predetermined value is, for example, "L1 (such a predetermined length of the paper P as related to a projecting length from the roller pair 45 along the conveyance direction)+L2 (such a length of the downstream path R2 as from the head 10 to the roller pair 45)", as depicted in FIG. 1.

When it is determined that "PL−Px" is smaller than the predetermined value (S9: No), then the CPU 1*c*1 carries out "Conveyance control (stopping and drying in the downstream path)" (S10). In S10, the CPU 1*c*1 controls the conveyance unit 40 to stop the paper $P_n$, which passes through the same path as in S4 and on which the recording is carried out either on the first surface in the case of the single side recording or on both surfaces in the case of the both side recording, in a state of being at least partially within the downstream path R2 before being received by the receiving unit 60. Then, the CPU 1*c*1 controls the conveyance unit 40 to convey the paper $P_n$ in the direction D1 after the paper $P_n$ is dried, and causes the receiving unit 60 to receive the paper $P_n$ with its ink jetted surface facing (the board side of) the receiving unit 60.

Figure 7:
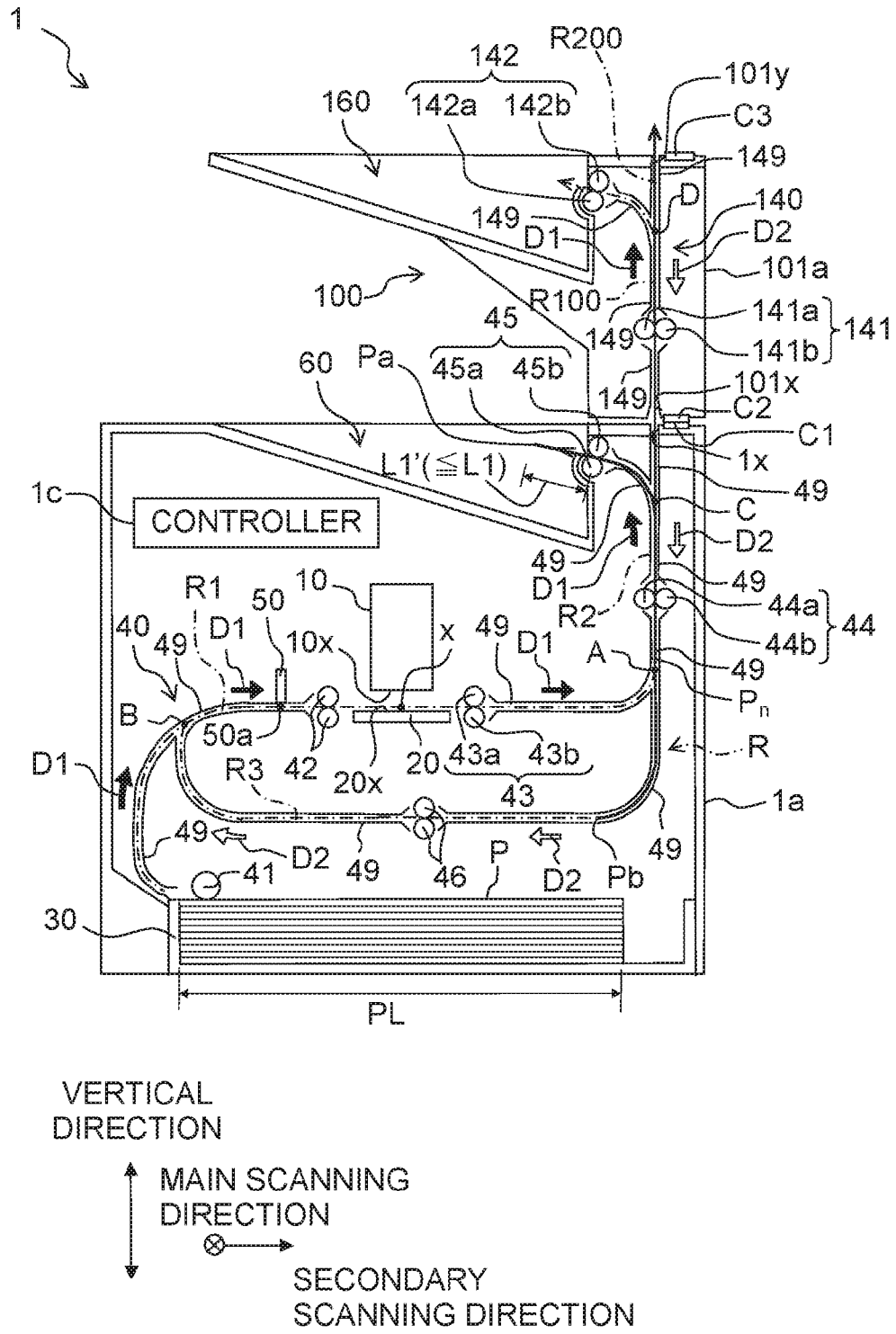
FIG. 7 is a schematic lateral view showing a state of the recording paper stopping in a switchback path, in a step S12 "Conveyance control (stopping and drying in the switchback path)" of FIG. 4B.

When it is determined that "PL−Px" is equal to or larger than the predetermined value (S9: Yes), then the CPU 1*c*1 prescribes a stop position for the paper $P_n$ in the switchback path R3 (S11). Here, in the above stop position, the paper $P_n$ does not contact with the roller pair 46. As depicted in FIG. 7 in particular, the stop position is prescribed such that the paper $P_n$ may be stopped before the end Pb (to be referred to below as "posterior end") of the paper $P_n$ according to the direction D2 arrives at the roller pair 46. Further, the CPU 1*c*1 prescribes the stop position such that the smaller the value of "PL−Px", the shorter the length of the paper $P_n$ extending in the switchback path R3, and the predetermined length L1 may not be shorter than a projecting length L1' of the paper $P_n$ from the roller pair 45 along the conveyance direction while the more the sheets of the paper P received by the receiving unit 60, the shorter the projecting length L1'.

After step S11, the CPU 1*c*1 carries out "Conveyance control (stopping and drying in the switchback path)" (S12). In S12, the CPU 1*c*1 causes the paper $P_n$, which passes through the same path as in S4 and on which the recording is carried out either on the first surface in the case of the single side recording or on both surfaces in the case of the both side recording, to be conveyed to the switchback path R3 with the conveyance direction reversed before being received by the receiving unit 60. Then, as depicted in FIG. 7, the CPU 1*c*1 controls the conveyance unit 40 to stop the paper $P_n$ in a state of being at least partially within the switchback path R3. Then, the CPU 1*c*1 controls the conveyance unit 40 to convey the paper $P_n$ in the direction D1 after the paper $P_n$ is dried, and causes the receiving unit 60 to receive the paper $P_n$ with its ink jetted surface facing (the board side of) the receiving unit 60. That is, the CPU 1*c*1 controls the conveyance unit 40 to convey the paper $P_n$, on which the recording is carried out either on the first surface in the case of the single side recording or on both surfaces in the case of the both side recording, from the switchback path R3 to the downstream path R2 with the conveyance direction reversed again so as to be received by the receiving unit 60, after being stopped in the state of being at least partially within the switchback path R3. Further, in the case of the both side recording, the CPU 1*c*1 controls the conveyance unit 40 to return the paper $P_n$, on which the recording has been carried out on the first surface, to the upstream path R1 from the switchback path R3 without the conveyance direction reversed again, after being stopped in the state of being at least partially within the switchback path R3, such that the recording may be carried out on the second surface.

After steps S4, S8, and step S10 or S12, the CPU 1*c*1 sets "n=n+1" (S13). After step S13, the CPU 1*c*1 refers to the image data included in the recording command and determines whether or not there are recording data for the paper $P_n$ (S14). When it is determined that there are recording data for the paper $P_n$ (S14: Yes), then the CPU 1*c*1 returns the process to step S3. When it is determined that there are no recording data for the paper $P_n$ (S14: No), then the CPU 1*c*1 ends the present routine.

According to this embodiment as described above, when the recording is carried out the paper P, the CPU 1*c*1 determines whether or not it is necessary to stop and dry the ink jetted paper Pin the conveyance path R (S3: First determination process). Then, when it is determined that it is necessity to dry the paper P (S3: Yes), then it is determined whether or not "PL−Px" is equal to or larger than the predetermined value (S9: Second determination process). When it is determined that "PL−Px" is equal to or larger than the predetermined value (S9: Yes), then the CPU 1*c*1 controls the conveyance unit 40 to stop the paper P in the state of being at least partially within the switchback path R3 (S12: Conveyance control process). In S12 as depicted in FIG. 7, the CPU 1*c*1 controls the conveyance unit 40 to cause the receiving unit 60 to receive the paper $P_n$ with its ink jetted surface facing (the board side of) the receiving unit 60, after the paper $P_n$ is conveyed from the upstream path R1 to the downstream path R2 while the recording is carried out at the facing position X, and then conveyed to the switchback path R3 with the conveyance direction reversed, and then stopped in the state of being at least partially within the switchback path R3. By virtue of this, when it is necessary to stop and dry the ink jetted paper P in the conveyance path R, even when PL (the entire length of the paper P) is long, it is still possible to prevent the problem that the ink adhering to the paper P may transfer to the receiving unit 60 or the (other) paper P received by the receiving unit 60 during the paper P being stopped and dried.

Further, in order to prevent the problem that during the paper P of long PL stopping in the downstream path R2, an anterior end portion of the paper P is maintained in a state of contact with the receiving unit 60 or the (other) paper P received by the receiving unit 60 such that the ink adhering to the anterior end portion of the paper P may transfer to the receiving unit 60 or the paper P received by the receiving unit 60, it is also conceivable to convey the paper P toward the upstream path R1 with the conveyance direction reversed and stop the paper P in a state of being at least partially within the upstream path R1, such that the anterior end portion of the paper P may not contact with the receiving unit 60 or the paper P received by the receiving unit 60. In such a case, however, such a problem may arise that during the paper P being stopped and dried, the paper P is maintained in a state of facing the plurality of jet openings 14*a* and, due to curvature of the paper P or the like, the ink in the vicinity of the jet openings 14*a* may come to adhere to the paper P. According to this embodiment, though, such problems will not arise.

In step S9, the CPU 1*c*1 determines whether or not "PL−Px" is equal to or larger than the predetermined value. According to the above configuration, even when PL (the entire length of paper P) is long, as far as a small amount of the ink is jetted on the anterior end portion of the paper P, it is still possible to reduce the time from the paper P being stopped to being received by the receiving unit 60 so as to raise the recording speed, by stopping the paper P in the downstream path R2 but in the switchback path R3.

The switchback path R3 diverges from the downstream path R2 and returns to the upstream path R1. According to the above configuration, by making use of a path provided originally for the both side recording as the switchback path R3, there is no need to add another path and thus it is possible to avoid complicating the apparatus configuration. Further, in S12, the CPU 1c1 controls the conveyance unit 40 to stop the paper $P_n$ conveyed to the switchback path R3 in a position without contact with the roller pair 46 (see FIG. 7). According to the above configuration, by causing the paper $P_n$ conveyed to the switchback path R3 to stop in the position without contact with the roller pair 46, it is possible to prevent the ink adhering to the paper P from transferring to the roller pair 46 (eventually to prevent the ink adhering to the roller pair 46 from transferring to the paper P being conveyed along the switchback path R3). Further, when the paper $P_n$ conveyed to the switchback path R3 with the conveyance direction reversed is stopped in a position in contact with the roller pair 46, and is caused afterwards to attempt reversing its conveyance direction again, then there is a need to adopt a roller pair capable of bidirectional transport. According to the above configuration, however, there is no such need.

In S12, the CPU 1c1 controls the conveyance unit 40 to convey the both surface recorded paper P or the first surface recorded paper P from the switchback path R3 to the downstream path R2 with the conveyance direction reversed again to be received by the receiving unit 60, after the paper P is stopped in the state of being at least partially within the switchback path R3. According to the above configuration, compared to the case of the paper P being returned to the upstream path R1 again after being stopped in the switchback path R3, and then being conveyed from the upstream path R1 to the downstream path R2 to be received by the receiving unit 60, it is possible to reduce the time from the paper P being stopped to being received by the receiving unit 60 so as to raise the recording speed.

In S12, the CPU 1c1 controls the conveyance unit 40 to return the first surface recorded paper P to the upstream path R1 from the switchback path R3 without the conveyance direction reversed again, such that the recording may be recorded on the second surface after the paper P is stopped in the state of being at least partially within the switchback path R3. According to the above configuration, it is possible to carry out the both side recording appropriately.

Before step S12, the CPU 1c1 prescribes the stop position for the paper Pin the switchback path R3 such that the smaller the value of "PL−Px", the shorter the length of the paper $P_n$ extending in the switchback path R3 (S11: First prescription process). According to the above configuration, the smaller the "PL−Px" of the paper P, the more reduced is the time from the paper P being stopped to being received by the receiving unit 60, such that it is possible to raise the recording speed.

In S12, the CPU 1c1 stops the paper $P_n$ conveyed to the switchback path R3 in such a state that the predetermined length L1 is not shorter than the projecting length L1' of the paper $P_n$ from the roller pair 45 along the conveyance direction (see FIG. 7). According to the above configuration, it is possible to more reliably prevent the problem that during the paper P being stooped and died, the ink adhering to the paper P may transfer to the receiving unit 60 or the paper P received by the receiving unit 60.

Before S12, the CPU 1c1 prescribes the stop position for the paper P in the switchback path R3 such that the more the sheets of the paper P received by the receiving unit 60, the shorter the projecting length L1' (S11: Second prescription process). According to the above configuration, it is possible to more reliably prevent the ink from adhering to the paper P received by the receiving unit 60.

The conveyance unit 40 includes the spur rollers (the rollers 43a to 45a) in contact with the paper P in the downstream path R2 to convey the paper P. Those spur rollers have a small contact area with the paper P, so as to be in point contact with the paper P. According to the above configuration, therefore, it is possible to prevent the ink adhering to the paper P from transferring to the rollers 43a to 45a when the paper P finished with the recording is conveyed along the downstream path R2 (eventually to prevent the ink adhering to the rollers 43a to 45a from transferring to the paper P being conveyed along the downstream path R2).

The expanded unit 100 is attachable to and removable from the printer 1. Hence, the CPU 1c1 determines whether or not the expanded unit 100 is installed on the printer 1 (S5: Third determination process). When it is determined that the expanded unit 100 is installed on the printer 1 (S5: Yes), then when no receiving unit is designated, the CPU 1c1 carries out "Conveyance control (stopping and drying in the expanded conveyance path)" (S8). When being stopped and dried in the expanded conveyance path R100, even the long paper P is often situated with the posterior end Pb past the facing position X (see FIG. 5). According to the above configuration, therefore, it is possible to swiftly carry out the recording on the next sheet of the paper P, thereby enabling the recording speed to be raised.

Next, another embodiment of the present teaching will be explained.

This embodiment is the same as the embodiment described above except for the aspect that "PL" is adopted instead of "PL−Px" in step S11.

According to this embodiment, in step S11, the CPU 1c1 prescribes the stop position such that the shorter the "PL" (the entire length of the paper P), the shorter the length of the paper $P_n$ extending in the switchback path R3. According to the above configuration, the shorter the "PL" of the paper P, the more reduced is the time from the paper P being stopped to being received by the receiving unit 60, such that it is possible to raise the recording speed.

While the embodiments of the present teaching were explained above, the present teaching is not limited to the embodiments described above but, as in the following manner for example, various design changes are possible as far as confined to the description of the appended claims.

The liquid jetting unit is not limited to being of line type but may be of serial type. The liquid jetted by the liquid jetting unit is not limited to ink but may be any liquid (for example, a pretreatment liquid). The number of liquid jetting units included in the recording apparatus may be one or be any number more than one. The container unit is not limited to being attachable to and removable from the case of the recording apparatus but, for example, may be drawable out of the case or openable and closable to the case (a manual feed tray or the like). The receiving unit is not limited to being constructed from the top board of the case but, for example, may be constructed from such a member as attachable to and removable from or drawable out of or openable and closable to the case. The conveyance unit may include a belt or belts to replace or add to the rollers and guides. The conveyance member is not limited to the roller pairs but may be a belt(s) or the like. The support member is not limited to a roller pair but may be a belt, guide member, or the like. The conveyance path is not limited to the configuration as in the embodiments described above.

For example, the upstream path and/or the downstream path may have such a shape as along a horizontal plane. The switchback path may return to the downstream path. In such a case, the divergence position from the downstream path for the switchback path may be the same position as the mergence position into the downstream path for the switchback path. The recording medium is not limited to paper but, for example, may be any recordable medium such as cloth or the like. The recording apparatus according to the present teaching is not limited to a printer but may be a facsimile machine or a photocopy machine. The recording apparatus according to the present teaching may have an expanded unit(s) which is not attachable and removable. In the second determination process according to the above (former) embodiment, it is determined whether or not "PL−Px" is equal to or larger than the predetermined value. However, it may be determined whether or not "PL" (the length of the recording medium along the conveyance direction) is equal to or larger than the predetermined value in the second determination process. The "predetermined value" used in the second determination process and the "predetermined length (L1)" related to the projecting length of the recording medium from the support member along the conveyance direction may be determined in accordance with various factors such as the texture of the recording medium, the angle of the support member nipping the recording medium, and the like.

What is claimed is:

1. A recording apparatus configured to jet liquid onto a recording medium comprising:

a liquid jetting unit including a plurality of nozzles to jet the liquid;

a container unit configured to contain the recording medium to be fed to the liquid jetting unit;

a receiving unit configured to receive the recording medium on which the liquid has been jetted by the liquid jetting unit;

a conveyance unit configured to convey the recording medium from the container unit to the receiving unit via a facing position facing the plurality of nozzles; and a controller configured to control the conveyance unit and the liquid jetting unit, wherein inside the recording apparatus, a conveyance path is defined to extend from the container unit to the receiving unit via the facing position facing the plurality of nozzles;

wherein the conveyance unit is configured to convey the recording medium along the conveyance path which includes an upstream path from the container unit to the facing position, a downstream path from the facing position to the receiving unit, and a switchback path diverging from the downstream path and returning to the upstream path or the downstream path; and wherein the controller is configured to carry out:

determining whether or not it is necessary to stop and dry the liquid jetted recording medium in the conveyance path, under a condition that recording is carried out on the recording medium, determining whether or not a first length of the recording medium along a conveyance direction for the conveyance unit to convey the recording medium is equal to or larger than a predetermined value, under a condition that it is determined that it is necessary to dry the recording medium, and controlling the conveyance unit to convey the recording medium, which is conveyed from the upstream path to the downstream path and finished with the recording carried out at the facing position, to the switchback path by reversing the conveyance direction and stop the recording medium in a state of being at least partially within the switchback path, and then to cause the receiving unit to receive the recording medium with its liquid jetted surface facing the receiving unit, under a condition that it is determined that the first length is equal to or larger than the predetermined value.

2. The recording apparatus according to claim 1, wherein in determining whether or not the first length of the recording medium is equal to or larger than the predetermined value, the controller is configured to determine whether or not a value is equal to or larger than the predetermined value, wherein the value is obtained by subtracting a second length from the first length of the recording medium, the second length being a length along the conveyance direction from an end of the recording medium, in the direction from upstream toward downstream of the downstream path, to an area closest to the end in the conveyance direction among areas of the recording medium that a predetermined amount or more of the liquid is jetted therein.

3. The recording apparatus according to claim 2, wherein before controlling the conveyance unit to convey the recording medium finished with the recording at the facing position to the switchback path by reversing the conveyance direction, the controller prescribes a stop position for the recording medium in the switchback path such that the smaller the value obtained by subtracting the second length from the first length of the recording medium, the shorter the length of the recording medium extending in the switchback path.

4. The recording apparatus according to claim 1, wherein the switchback path diverges from the downstream path and returns to the upstream path, the conveyance unit includes a conveyance member configured to contact with the recording medium in the switchback path to convey the recording medium, and the controller is configured to control the conveyance unit to stop the recording medium conveyed to the switchback path in a position without contact with the conveyance member.

5. The recording apparatus according to claim 4, wherein the controller is configured to control the conveyance unit to stop the recording medium, in which the recording is finished on a first surface and a second surface on the other side of the first surface with the recording or in which the recording is finished on the first surface, in the state of being at least partially within the switchback path and, thereafter, to convey the recording medium from the switchback path to the downstream path with the conveyance direction reversed again so that the recording medium is received by the receiving unit.

6. The recording apparatus according to claim 5, wherein the controller is configured to control the conveyance unit to stop the recording medium, in which the recording is finished on the first surface, in the state of being at least partially within the switchback path and, thereafter, to return the recording medium from the switchback path to the upstream path without the conveyance direction reversed again so that the recording is carried out on the second surface.

7. The recording apparatus according to claim 1, wherein before controlling the conveyance unit to convey the recording medium finished with the recording at the facing position to the switchback path by reversing the conveyance direction, the controller prescribes a stop position for the recording medium in the switchback path such that the shorter the first length of the recording medium, the shorter the length of the recording medium extending in the switchback path.

8. The recording apparatus according to claim 1, wherein the conveyance unit includes a support member configured to support the recording medium at the most downstream point in the downstream path, and the controller is configured to control the conveyance unit to stop the recording medium conveyed to the switchback path in a state that a projecting length of the recording medium from the support member along the conveyance direction is shorter than a predetermined length.

9. The recording apparatus according to claim 8, wherein before controlling the conveyance unit to convey the recording medium finished with the recording at the facing position to the switchback path by reversing the conveyance direction, the controller prescribes a stop position for the recording medium in the switchback path such that the more the numbers of recording media received by the receiving unit, the shorter the projecting length.

10. The recording apparatus according to claim 1, wherein the conveyance unit includes a spur roller configured to contact with the recording medium in the downstream path to convey the recording medium.

11. The recording apparatus according to claim 1, further comprising a removable expanded unit including an expanded receiving unit other than the receiving unit to receive the recording medium on which the liquid is jetted by the liquid jetting unit, and an expanded conveyance unit to convey the recording medium along an expanded conveyance path which diverges from the downstream path to extend toward the expanded receiving unit; the expanded conveyance path is longer than such a part of the downstream path as on the downstream side from the divergence position from the expanded conveyance path;

the controller is configured to carries out:

determining whether or not the expanded unit is installed; and under a condition that it is determined that the expanded unit is installed and neither the receiving unit nor the expanded receiving unit is designated to receive the recording medium, the controller is configured to control the conveyance unit and the expanded conveyance unit to cause the expanded receiving unit to receive the recording medium, which is conveyed from the upstream path to the downstream path and finished with the recording at the facing position, with its liquid jetted surface facing the expanded receiving unit, after being conveyed toward the expanded receiving unit by the expanded conveyance unit and being stopped in a state of being at least partially within the expanded conveyance path.

* * * * *